US007147737B2

(12) United States Patent
Rassl et al.

(10) Patent No.: US 7,147,737 B2
(45) Date of Patent: Dec. 12, 2006

(54) BANDEROLING MACHINE

(75) Inventors: Roland Rassl, Tannenweg (DE); Manfred Kirchmann, Ölmühle (DE)

(73) Assignee: Emil Pester GmbH, Wolferschwenden (DE)

( * ) Notice: Subject to any disclaimer, the term of this patent is extended or adjusted under 35 U.S.C. 154(b) by 64 days.

(21) Appl. No.: 10/746,016

(22) Filed: Dec. 23, 2003

(65) Prior Publication Data

US 2004/0140044 A1 Jul. 22, 2004

(30) Foreign Application Priority Data

Jan. 16, 2003 (DE) ..... 103 01 347

(51) Int. Cl.
*B65H 21/00* (2006.01)
*B65H 69/06* (2006.01)

(52) U.S. Cl. ..... 156/159; 156/157; 156/502; 156/504; 242/552; 242/553; 242/556

(58) Field of Classification Search ..... 156/157, 156/159, 502, 504; 242/551, 552, 553, 556
See application file for complete search history.

(56) References Cited

U.S. PATENT DOCUMENTS 4,894,679 A * 1/1990 Rachwal et al. ..... 355/18
5,247,779 A 9/1993 Wirsig et al.
5,318,646 A * 6/1994 Cardini et al. ..... 156/157
5,514,237 A * 5/1996 Emenaker et al. ..... 156/159
5,653,848 A * 8/1997 Yamamoto et al. ..... 156/504
5,863,381 A * 1/1999 Magota et al. ..... 156/507
6,533,213 B1 * 3/2003 Durrance et al. ..... 242/560.1
6,814,827 B1 * 11/2004 Futase ..... 156/157

FOREIGN PATENT DOCUMENTS

DE 22 23 907 A 12/1973
DE 73 33 907 U 2/1974
DE 23 20 423 A 4/1974
DE 25 34 156 A1 2/1977
DE 25 37 882 A1 3/1977
DE 195 22 110 A1 1/1997
DE 197 15 263 A1 10/1998
GB 1184591 3/1970

* cited by examiner

*Primary Examiner*—Mark A. Osele
(74) *Attorney, Agent, or Firm*—Notaro & Michalos P.C.

(57) ABSTRACT

A banderoling machine joins film webs from a roll to form a film curtain. Film is placed around material to be banderoled to form a loop and the loop is tightened to clamp at least one of the film webs, and is heat-sealed and separated from the remainder of the film. The web need not be positioned exactly and there is no film waste by providing, a film changing unit where both the working film web and the supply film web are guided through a film sealing unit having at least one separating heat-sealing device to produce a pinch-separating seam between the old working film web and the supply film web and between the excess supply film web and the remainder of the old working film web.

20 Claims, 3 Drawing Sheets

BANDEROLING MACHINE

FIELD AND BACKGROUND OF THE INVENTION

The invention relates to a banderoling machine with film rolls arranged on both sides of a feed table, whose film webs are joined together by a sealing seam to form a film curtain which passes through a slot in the feed table, wherein the material to be banderoled is pushed towards the film curtain, the film is placed around the material to form a loop and the loop is tightened by means of a tensioning device, which temporarily clamps at least one of the film webs, and is heat-sealed by means of a heat-sealing device and separated from the remainder of the film.

Such a banderoling machine is known for example from DE 25 34 156. A disadvantage with the known banderoling machine is that the packaging process must be interrupted for two to three minutes when changing the films.

Furthermore, banderoling machines are known from the prior art in which the film changing takes place automatically. In this case, in a first working process the start of the supply film web is positioned exactly and in a second working process it is heat-sealed to the working film web. In a third working process the old working film web is then separated from the new working film web using a knife. If the supply film web is not positioned exactly, it may also be necessary to cut off the excess of the supply film web using a knife for example. In this case, waste film accumulates. The banderoling machine from the prior art has several disadvantages. Firstly, the start of the supply film web must be positioned exactly to avoid any excess film from occurring. Should the supply film web not be positioned exactly, it is necessary to cut off the excess film. Another disadvantage with the banderoling machine is that a heat-sealing device and a separating device separate therefrom for separating the old working film web from the new working film web must be provided.

SUMMARY OF THE INVENTION

The object of the invention is thus to propose a banderoling machine wherein the supply film web need not be positioned exactly and wherein no loose film waste is produced.

The object forming the basis of the invention is solved by providing at least on one side of the feed table, preferably on both sides of the feed table, a film changing unit comprising at least one supply film roll and one working film roll, wherein both the working film web and also the supply film web is guided through one, preferably two film sealing units, wherein the film sealing unit comprises at least one separating heat-sealing device to produce a pinch-separating seam between the old working film web and the supply film web and between the excess supply film web and the remainder of the old working film web in one working process. With the banderoling machine according to the invention it is possible for the film to be changed automatically without the packaging process needing to be interrupted. By using a separating heat-sealing device it is achieved that the supply film web and the working film web are heat-sealed to form a new working film web and at the same time the excess supply film web is heat-sealed with the old working film web. The separation of the film webs takes place virtually in the same working step as the heat-sealing of the film ends. As a result of these measures, it is achieved that no loose film waste occurs.

It is also the object of the invention to propose a method for executing a film change in the banderoling machine according to the invention wherein no loose film residue accumulates.

This object is solved by the fact that the supply film roll is placed on a corresponding holder and the supply film web is guided through a first film slot assigned to said web between the first and the central component of the film sealing unit, said supply film web is guided around the central component and guided through a second film slot through which the working film web runs, wherein the excess supply film is then clamped with a clamping mechanism, whereupon at a later point in time the supply film web and the working film web lying next to it are separated by means of the separating heat-sealing unit and in the same working step the old working film web is heat-sealed to the supply film web and the excess supply film web is heat-sealed to the remainder of the old working film web by means of the separating heat-sealing device, whereupon the old working film roll is exchanged for a new supply film roll. The procedure is then repeated again as described. The method according to the invention has the advantage that no loose film waste accumulates since at the same time as the production of the new working film web comprising the old working film web and the supply film web, the excess supply film web is heat-sealed to the remainder of the old working film web.

An advantageous embodiment provides that the film sealing unit consists of two separating heat-sealing devices, preferably arranged next to one another, each having a film slot, which are arranged such that substantially three components, separate from one another, are formed by the two, preferably parallel, film slots, wherein the supply film web is guided through the two film slots and partly loops around the central component and the working film web is guided through one of the two film slots, preferably substantially vertically. This advantageous embodiment of the film sealing unit makes it possible to achieve easy handling during threading of the new supply film web. This need only be guided through the two parallel slots. There is no need for exact positioning of the film in the running direction since the excess supply film is heat-sealed to the remainder of the old working film web by means of the separating heat-sealing device. Furthermore, any risk of injury is virtually eliminated since the film slots have a width of around five millimetres. However, it is also feasible to work with larger film slot widths here. In the embodiment of the film-sealing unit according to the invention each of the two separating heat-sealing devices is divided into two components. All components are surrounded by a smooth housing in order to ensure friction-free sliding of the film webs as far as possible. The working film web is advantageously guided vertically through one or the other film slot in order to cause as little friction losses as possible.

A suitable embodiment provides that each of the two separating heat-sealing devices consists of assemblies separated from one another by a film slot, namely a heating element and a countertool, wherein two spaced clamping strips, preferably made of silicone rubber, are provided on the heating element or on the countertool and a separating edge is provided either on the heating element or on the countertool, wherein at least one of the two assemblies is movable onto the other. Each separating heat-sealing unit is thus distributed over two components of the film sealing unit. At least one of the assemblies, that is either the heating element or the countertool, can be moved towards the other. The films located one above the other are clamped by means of the clamping strips and then separated by means of the separating edge, whereupon respectively two film ends located one above the other are heat-sealed together by means of the heating element. It is feasible that the heating elements or the countertools or both are configured as displaceable. The movement towards one another is advantageously accomplished by means of a pneumatic or hydraulic cylinder with piston rods, acting in two directions.

It is advantageously provided that the separating edge is provided on the heating elements, wherein the heating elements are attached statically in the central component of the film sealing unit and the separating edges are respectively aligned in the direction of the relevant film slot and in each other component there is provided a countertool with rubber-like separating profiles, which is displaceable in the direction of the central component. In this case, the countertools are connected with a piston rod of a pneumatic or hydraulic cylinder which makes movement possible. The countertool is thus displaced towards the film webs located one above the other. Said webs are clamped by means of clamping strips whereupon as a result of the further movement of the countertool, the film webs are pressed against the separating edge, resulting in separation of the film webs. As a result of further movement of the countertool, the countertool with the separating profiles comes to rest against the heating element. The film ends located therebetween are heat-sealed. In this case, the shape of the separating profile is matched to the shape of the heating element in order to obtain two optimum heat-sealed seams. After the separating and heat-sealing process, the countertool is moved back towards its original position.

In order to improve the clamping action of the two film webs located one above the other, it is advantageously provided that a spring-loaded plate with an opening for clamping the film webs before the separating heat-sealing process is inserted before each heating element in the direction of the film slot, wherein the film webs can be clamped between the countertool with clamping strips and the plate. In this case, for example, the countertool with the clamping strip is moved towards the plate and thus clamps the two film webs located one above the other between clamping strip and plate. As a result of a further movement of the countertool towards the heating element, the plate is displaced with the opening over the heating element so that the heating element with the separating edge is pressed against the film webs located one above the other so that the clamped film webs are separated. As a result of further movement of the countertool, the suitably shaped heating element comes to rest against the rubber-like separating profiles of the countertool. Here the ends of the film webs are heat-sealed. The heating element is advantageously coated with Teflon (polytetrafluoroethylene). The heating element is advantageously constructed so that it tapers to a pointed separating edge and the sides of the elongated separating edge serving as heat-sealing surfaces are bent concavely. Optimum resting of the sides of the separating edge serving as heat-sealing surfaces against the separating profile is hereby achieved.

According to a further development of the invention, it is provided that the countertool is formed from a bar of rubber-like material, preferably silicone rubber, wherein projecting areas for clamping the film and for separating the films located one above the other are provided on its front surface and comprising somewhat recessed areas for sealing the old working film web and the supply film web. In this case, the heating element surface should be adapted to ensure the function of the individual areas of the countertool front surface. According to an advantageous embodiment, the heating element is pulse-heatable, and thus consists of a thin metal plate that can be heated in a very short time. Advantageously no cooling device is required with any design of heating element since the film rolls are only changed about once an hour according to thickness so that there is a sufficiently long cooling time for cooling the heating element.

In order to ensure that the excess supply film web cannot swing around uncontrollably after threading said supply film web and in order to ensure that the already threaded supply film web does not slip out of the film slots, there is advantageously provided a clamping mechanism for clamping the excess supply film web before the separating heat-sealing process, preferably on the underside of the central component.

In a further development it is provided that the clamping mechanism consists of a strip, which can be pressed by means of spring force against the underside of the central component of the film sealing unit, wherein a magnet is provided for fixing the strip in an open position. The supply film web is threaded into the two film slots as described above and then clamped. After the separating heat-sealing process has ended, the clamping strip is preferably moved by hand against the spring force so that the excess supply film web heat-sealed to the remainder of the working film web can be removed with the remainder of the old working film web. In this case, the clamping strip is held in an open position by means of one or a plurality of magnets so that the clamping mechanism need not be reopened to thread in the new supply film web.

It is advantageously provided that the working film web is guided through a film-web intermediate storage device. Such a device should ensure that the packaging process can be continued during the heat-sealing process between the old film web and the supply film web. During this time the required working film is drawn from the film-web intermediate storage device.

In one embodiment of the invention it is provided that the film-web intermediate storage device consists of a film rocker supported on one side, wherein film guide rollers are provided on the film rocker and on one casing wall of the banderoling machine, wherein the working film web is guided alternately around the guide rollers on the casing wall and around the guide rollers on the film rocker. Since no film web can be withdrawn from the new working roll during the heat-sealing and strengthening process, the working film web is withdrawn from the film-web intermediate storage device. In this case, the film rocker moves towards the guide rollers on the casing wall. The film web is guided between the rollers similar to the pulley block principle. Preferably pneumatic drum brakes are advantageously provided on the guide rollers. These are generally active in order to prevent any unintentional rollaway of the film web. In order to ensure that the banderoling process is not interrupted by any unintentional tearing off of the working film web, it is advantageously provided that on reaching a certain rocking angle, the film rocker triggers a switch with which the preferably compressed-air actuated film roller brakes are actuated.

In order to ensure that the supply film web can be inserted into the film slots simply and without any obstacles, it is advantageously provided that a tiltable working-film-web guide roller is provided at a distance from the film sealing unit, which can be tilted into two positions which are characterised in that the working film always runs along the outer edge of the film slot depending on which film slot said working web is guided straight through. This ensures that the inner edge of the film slot, that is the edge at the central component, is free so that the supply film web can be laid along this inner edge.

According to a further embodiment, it is provided that a device for continuously determining the roll thickness is provided, especially in the form of a light sensor to output a control signal for triggering the film clamping device and/or the heating device for heating the corresponding heating element. Preferably continuous scanning of the film roll thickness ensures that the film clamping process and/or the heating process is triggered in good time before the working film web has been completely unwound from the working film roll.

In one embodiment of the invention it is provided that a temperature sensor is provided on the heating elements to trigger a control signal for triggering the separating heat-sealing process on reaching a desired temperature, preferably 180 degrees. The temperature sensor ensures that the separating heat-sealing process is triggered directly after reaching the required temperature so that no loss of time occurs. With polyethylene film the optimum temperature of the heating element can vary in a range between about 170° C. and about 220° C. The optimum temperature depends on the material.

It is especially suitable if the supply film roll and the working film roll do not have their own drive. The film webs are merely unrolled into the film curtain by feeding the material. Brakes, preferably pneumatic brakes, are provided both for the working film roll and for the supply film roll, which should ensure that the film webs are under a certain tension. Furthermore, any unintentional rollaway should be avoided. If necessary, for example if film needs to be supplied, the brakes can be triggered by a switch on the film rocker. The brakes are generally closed. The brakes are only released when a switch is actuated by movement of the rocker.

In a further development of the method according to the invention it is provided that a separate heat-sealing process comprises the following steps: firstly the countertool is moved towards the spring-loaded plate. There the supply film web and the working film web adjacent thereto is clamped between the clamping strips of the countertool and the spring-loaded plate with the opening. In the event that the countertool is formed completely of rubber-like material, the spring-loaded plate can be dispensed with. Heating of the heating element takes place before, during or after the clamping process. After a desired temperature has been reached, the spring-loaded plate is pressed by means of the countertool against the spring force towards the heating element. In this case, the heating element with the separating edge pushes through the opening in the spring-loaded plate. The film webs located one above the other are separated and the ends located one above the other are respectively heat-sealed. The excess supply film web is thus heat-sealed with the remainder of the old film web and at the same time, the old working film web is heat-sealed with the supply film web so that a new working film web is formed. Before the countertool moves completely back into its starting position after the separating and heat-sealing process, the countertool remains on the spring-loaded plate to ensure sufficient strengthening of the pinch-separating seam.

According to an advantageous further development of the method according to the invention, it is provided that the working film web guide roller is tilted from a first position into a second position by means of a compressed-air cylinder so that the new working film web runs along the outer edge of the film slot. This tilting takes place directly after the clamping of the film webs to the plate has been triggered.

It is advantageously provided that the film clamping process and the heating of the corresponding heating element is triggered by the output of a control signal from the device for determining the film roll thickness when the working film roll goes below a minimum thickness. Optimum usage of material is hereby achieved. The correct moment for changing the film roll cannot be missed.

BRIEF DESCRIPTION OF THE DRAWINGS

The invention is explained in further detail with reference to the drawings which show various exemplary embodiments.

In the figures.

DESCRIPTION OF THE PREFERRED EMBODIMENTS

Figure 1:
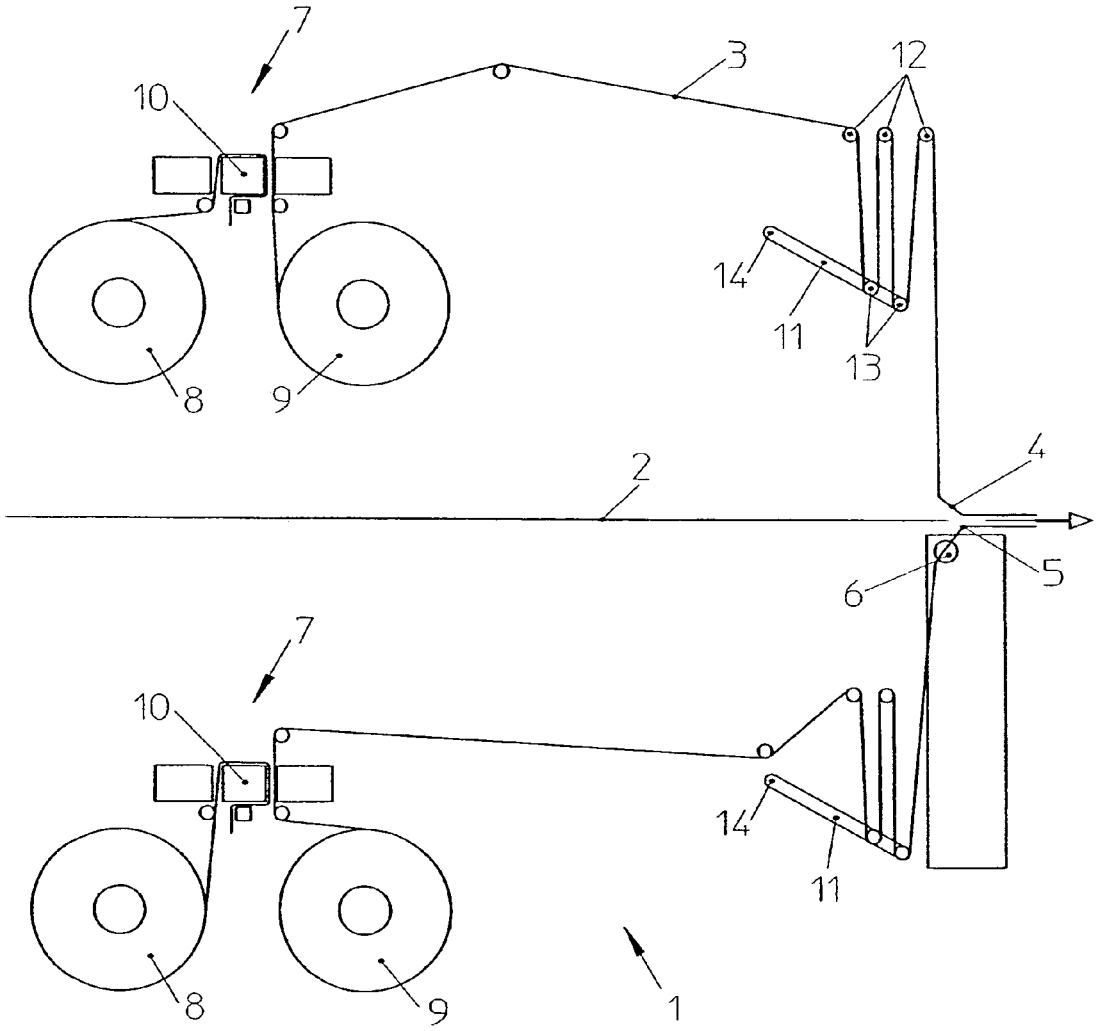
FIG. 1: shows a schematic diagram of a banderoling machine.

FIG. 1 shows a schematic diagram of a banderoling machine 1. Located at the centre of the drawing is a feed table 2. Located on each side of the feed table are working film webs 3 which are joined to form a film curtain 4 by means of a sealing seam. The film curtain 4 passes through a slot 5 in the feed table 2. The material to be banderoled not shown is pushed towards the film curtain. The film curtain in this case is placed around the material to form a loop not shown. The loop is tightened by means of a tensioning device 6 which temporarily clamps one of the working film webs 3 and is heat-sealed by means of a heat-sealing device not shown and separated from the remainder of the film. A combined separating heat-sealing process can advantageously be used here.

A film-changing unit 7 is located on each side of the feed table. Each film changing unit 7 has a supply film roll 8 and a working film roll 9. Both film rolls 8, 9 are located at a height and are rotatably mounted. The working film webs 3 are withdrawn from the working film rolls 9 by pushing the material into the film curtain 4. A film sealing unit 10 is attached above the film rolls 8, 9. On the right-hand side of the drawing are located film-web intermediate storage devices configured as film rockers 11. The working film web 3 is alternately guided between film guide rollers 12 on the casing and film guide rollers 13 on the film rocker 11 in the fashion of a pulley block. In this case, the film guide rollers 12, 13 are mounted overhung on one side which facilitates easy threading of the working film web 3 into the film-web intermediate storage device 11. The film-web intermediate storage device 11 ensures that the banderoling process can also be continued during changing of the film rolls. During this time the working film web 3 is taken from the film-web intermediate storage device and not directly from the working film roll 9. In this case, the film rocker 11 moves upwards about a pivot 14 and at a certain rocker angle triggers a switch not shown which triggers the working film roll brake, also not shown.

Figure 2:
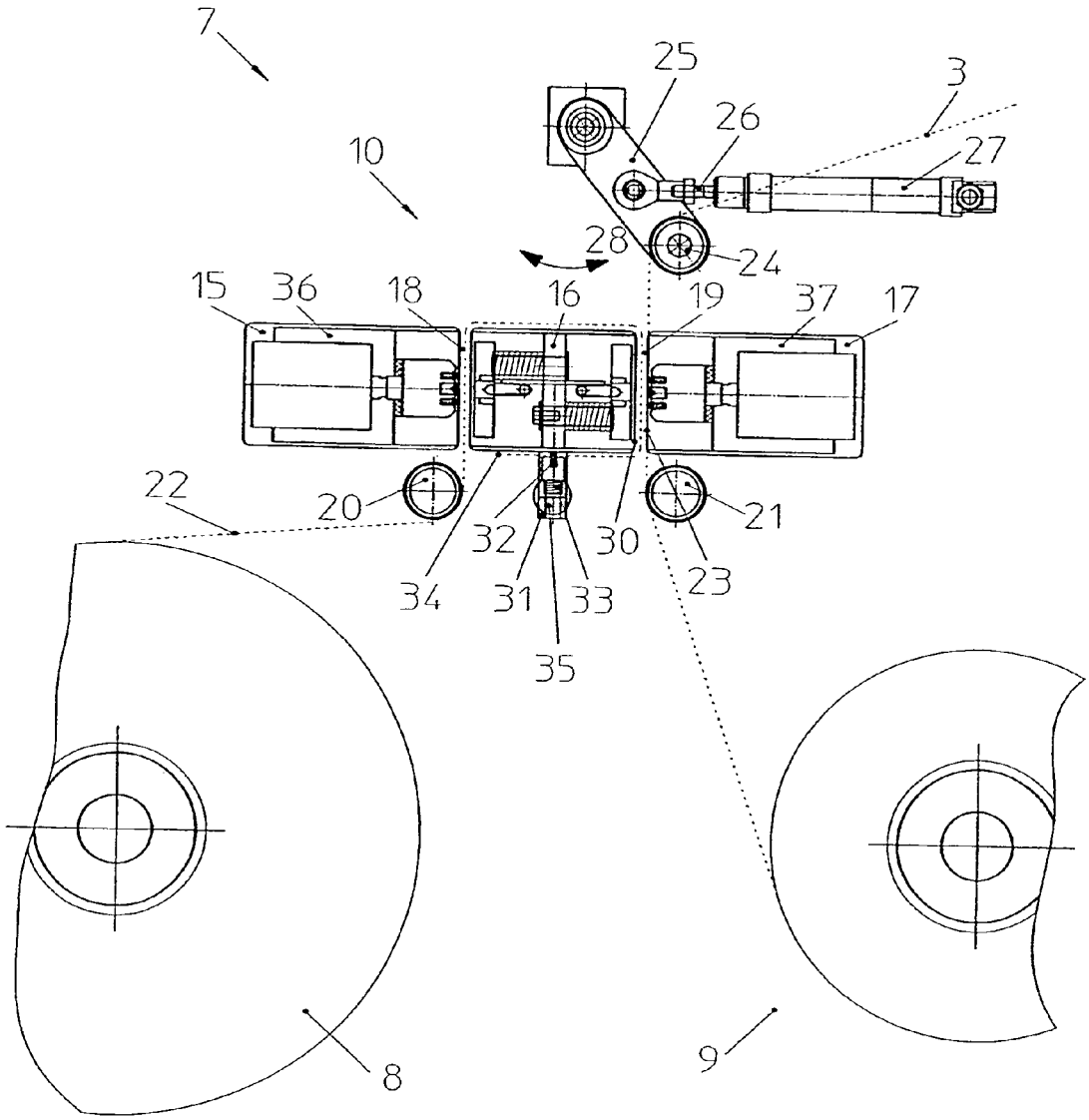
FIG. 2: shows a film changing unit with left supply film roll and right working film roll.

The film roll changing unit 7 is shown in detail in FIG. 2. The film sealing unit 10 consists of three components 15, 16, 17. The two outer components 15, 17 are separated from the central component by respectively one film slot 18, 19.

Below the film sealing unit 10 are located guide rollers 20, 21 which ensure that both the working film web 3 and the supply film web 22 are guided substantially vertically into the film slots 18, 19.

The working film web 3 enters the film slot 19 substantially vertically via the guide roller 21 and is there guided upwards along the outer slot side 23 and deflected over a working film web guide roller 24. The working film web guide roller 24 is attached to a rotatably mounted lever 25. The lever 25 and with this the working film web guide roller 24 can be moved from a first position 28 into a second position 29 shown in FIG. 3 by means of a piston rod 26 with a cylinder 27 pivoted on the lever 25, which is affixed to the casing. The positions 28, 29 are selected so that the respective working film web 3 is guided substantially vertically through the respective film slot 18, 19 in order to ensure optimum threading of the supply film web 22.

The supply film web 22 is threaded in before the separating heat-sealing process, as shown in FIG. 2. This is achieved by inserting the supply film web around the guide roller 20 from below into the film slot 18, guiding said web up around the component 16 and then guiding said web from top to bottom through the film slot 19 along the inner slot side 30. The film supply web is then clamped by means of a clamping mechanism 31. The clamping mechanism 31 consists of a strip 32 which is pressed against the component 16 by means of springs 33. The supply film web 22 can be clamped between the strip 32 and the component 16. After the separating heat-sealing process has ended, the excess supply film web 34 is heat-sealed with the remainder of the old working film web. The clamping mechanism 31 can be triggered by pushing the strip 32 against the spring force. Especially easy operation is ensured by providing magnets 35 below the springs 33 which hold the strip 32 in an opened position so that the new supply film web can be threaded in with both hands.

As can be seen from FIG. 2, the film sealing unit substantially consists of two separating heat-sealing devices 36, 37.

The structure of the separating heat-sealing devices 36 and 37 is described in detail with reference to FIG. 3.

Figure 3:
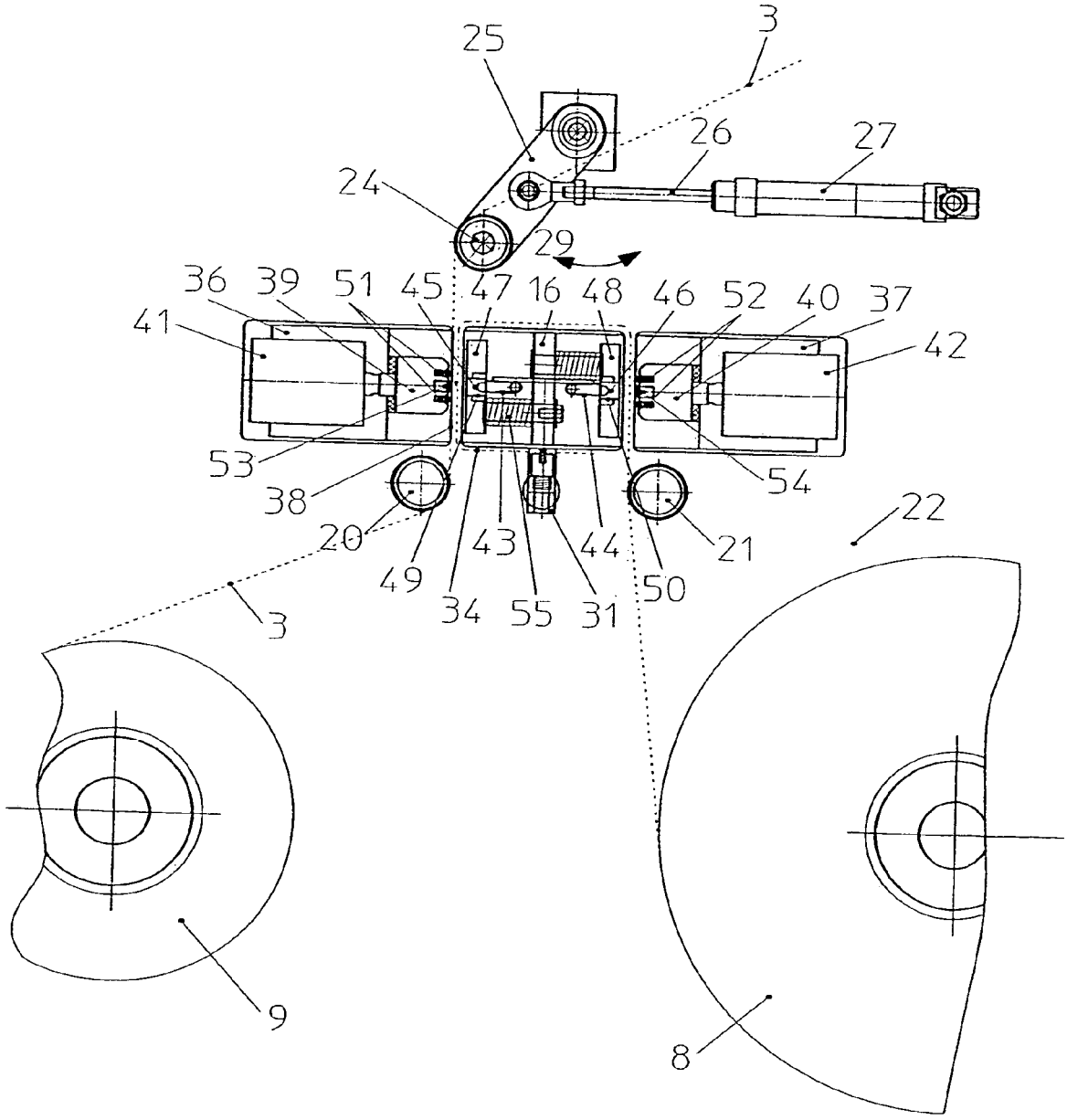
FIG. 3: shows a film changing unit with left working film and right supply film roll.

In FIG. 3 a film roll change has already taken place. The working film roll 9 is now located on the left while the supply film roll is located on the right. The supply film roll is guided around a guide roller 21 through the film slot 19 around the component 16 and from there enters the clamping mechanism 31 through the film slot 18. The working film web guide roller 24 is located in position 29 which ensures that the working film web 3 is guided along the outer slot side 38 of the film slot 18. This ensures that the supply film web can be inserted into the film slots 18, 19 and clamped without being hindered by the working film web 3.

The separating heat-sealing devices 36, 37 are arranged horizontally. Said devices each consists of a countertool 39, 40, which can be moved towards component 16 by means of a pneumatic cylinder 41, 42, and of two heating elements 43, 44 arranged in component 16. The heating elements 43, 44 taper to a point at their end assigned to the appropriate film slot 18, 19, where they form a separating edge 45, 46. The surfaces at the side of the separating edges serve as heat-sealing surfaces. Each heating element 43, 44 is assigned a spring-loaded plate 47, 48 in the direction of the film slot. At the centre of the spring-loaded plates 47, 48 is located an opening 49, 50.

The countertools 39, 40 have two spaced clamping strips 51, 52 made of natural rubber. At the centre of the countertools 39, 40 are located separating profiles 53, 54 matched to the shape of the heating elements 43, 44 on which the heating elements 43, 44 come to rest after the sideward movement of the countertools and seal together the ends of the film webs 3, 22 located one above the other.

After a separating heat-sealing process has taken place between countertool and heating element, the empty old working film roll is removed with the excess supply film web 34 heat-sealed onto the remainder of the old working film web and is replaced by a supply film roll 8. The supply film web 22 is then guided around the component 16, as shown in FIGS. 2 and 3, and clamped by means of a clamping mechanism 31.

The roll thickness is determined by means of a light sensor. If no more light is reflected towards a sensor, the working film roll 9 is thus almost unrolled and a control signal is emitted. This triggers the film clamping process and the heating process for heating of the corresponding heating element 43 or 44. The subsequent process should then be described with reference to FIG. 3 again. The countertool 39 is moved towards the spring-loaded plate 47 by means of the pneumatic cylinder 41. The two film webs 3, 22 located one above the other are pressed towards the plate 47 by means of the clamping strip 51 and thus clamped. The countertool remains in this position until the actual temperature of the heating element 43 determined by a temperature sensor not shown reaches the desired temperature (around 180° C. for polyethylene). A control signal is then emitted, whereupon the countertool moves further towards component 16. In this case, the plate 47 is pressed against the spring force of the spring 55. The separating edge 45 of the heating element 43 separates the film webs located one above the other, which are still clamped. As a result of further movement of the countertool 39 by means of the pneumatic cylinder 41, the film ends respectively located one above the other after the separation are heat-sealed such that a pinched separating seam is formed on each side. During the movement of the countertool 39 towards component 16, the spring-loaded plate 47 is moved to the right so that the heating element 43 with the separating edge 45 is virtually pushed through the opening 49 in the plate 47, whereby the separating heat-sealing process is made possible.

After this separating heat-sealing process the countertool 39 is pushed slightly back towards its initial position by means of the pneumatic cylinder but only so far that the respectively two film ends heat-sealed together continue to be clamped between plate 47 and clamping strips 51. This clamping after separation and heat-sealing is necessary to ensure that the pinched separating seams are sufficiently strengthened.

During and/or after the countertool has moved back into its original position in component 15, the working film web guide roller attached to the lever 25 is moved into the position 28 shown in FIG. 2. This ensures that the new working film web consisting of the old working film web and supply film web is guided vertically in the film slot 19. Now, the old working film roll with the excess supply film web 34 heat-sealed thereto can be removed after releasing the clamping device 31 and replaced by a new supply film roll. The supply film web of the new supply film roll must now be threaded into the film sealing unit 10 as shown in FIG. 2 and clamped by means of a clamping mechanism 31. The process then begins again.

REFERENCE LIST

1 Banderoling machine
2 Feed table

3 Working film web
4 Film curtain
5 Slot
6 Tensioning device
7 Film changing unit
8 Supply film roll
9 Working film roll
10 Film sealing unit
11 Film rocker
12 Film guide rollers on casing wall
13 Film guide rollers on rocker
14 Pivot
15,16,17 Components of film sealing unit
18,19 Film slots
20,21 Guide rollers
22 Supply film web
23 Outer slot side
24 Working film web guide roller
25 Lever
26 Piston rod
27 Cylinder
28 Position 1
29 Position 2
30 Inner slot side
31 Clamping mechanism
32 Strip
33 Springs
34 Excess supply film web
35 Magnets
36,37 Separating heat-sealing device
38 Outer slot side
39,40 Countertool
41,42 Pneumatic cylinder
43,44 Heating elements
45,46 Separating edges
47,48 Spring-loaded plates
49,50 Opening in plate
51,52 Clamping strips
53,54 Separating profiles
55 Spring

The invention claimed is:

1. A banderoling machine for banderoling a material with film rolls arranged on both sides of a feed table, whose film webs are joined together by a seal seam to form a film curtain which passes through a slot in the feed table, wherein the material to be banderoled is pushed towards the film curtain, the film curtain is placed around the material to form a loop and the loop is tightened by means of a tensioning device, which temporarily clamps at least one of the film webs, and the loop is heat-sealed by means of a heat-sealing device and separated from the remainder of the film curtain, wherein at least on one side of the feed table, there is provided a film changing unit (7) comprising at least one supply film roll (8) of a supply film web and at least one working film roll (9) of a working film web, wherein the working film web (3) and the supply film web (22) guided through a film sealing unit (10), wherein the film sealing unit (10) comprises two separating heat-sealing devices (36,37), each adapted to produce a pinch-separating seam wherein each of the two separating heat-sealing devices (36,37) comprises assemblies separated from one another by a film slot (18,19), the assemblies comprise a heating element (43,44) and a countertool (39,40), wherein two appropriately spaced clamping strips (51,52), are provided on the heating element (43,44) or on the countertool (39,40) wherein a separating edge (45,46) is provided between the spaced clamping strips (51, 52) either on the heating element (43,44) or on the countertool (39,40), and wherein at least one of the two assemblies is movable onto the other, to produce the pinch-separating seam between the supply film web and the working film web and between an excess portion of the supply film web (34) and a remainder portion of the working film web, in one working process, wherein a central component (16) is provided between the heat-sealing devices (36,37) in a substantially side-by-side relationship with one film slot (18,19) located between each of the heat-sealing devices and the central component, wherein the supply film web (22) is guided through the two film slot (18,19) and partly loops around the central component (16), and wherein the working film web (3) is guided through one of the two film slots (18,19) and is substantially parallel to the two film slots (18,19).

2. The banderoling machine according to claim 1, wherein the film sealing unit (10) comprises two heating elements (43,44), each having a separating edge (45,46), wherein the heating elements (43,44) are attached statically within the central component wherein each separating edge (45,46) is respectively aligned substantially perpendicular to the corresponding one of the two film slots (18,19), wherein on the side of the heat-sealing devices opposite each separating edge there is provided a countertool (39,40) having elastomer separating profiles (53, 54), and wherein the countertool is displaceable in the direction of the central component (16).

3. The banderoling machine according to claim 1, wherein a spring-loaded plate (47,48) having an opening (49, 50) is provided outwardly of each heating element (43,44) and adjacent the film slot (18,19), and wherein the spring-loaded plate and the countertool having clamping strips (51,52) are configured to securely hold the film webs placed adjacent one another before the separating heat-sealing process.

4. The banderoling machine according to claim 1, wherein the countertool (39,40) is formed of elastomer material, or silicone rubber, wherein the countertool comprises projecting areas for clamping the film webs and for separating the film webs, placed adjacent one another, and recessed areas for sealing the working film web and the supply film web, and wherein the heating element is pulse-heatable.

5. The banderoling machine according to claim 1, further comprising a clamping mechanism (31) for clamping the excess portion of the supply film web (34) before the separating heat-sealing process, wherein the clamping mechanism is provided on the underside of the central component (16).

6. The banderoling machine according to claim 1, characterised in that the working film web (3) is guided through a film web intermediate storage device (11).

7. The banderoling machine according to claim 6, wherein the film web intermediate storage device (11) comprises a film rocker (11) pivotally mounted on one end, and film guide rollers (13,12) provided on the film rocker (11) and on one casing wall of the banderoling machine (1), wherein the working film web (3) is alternately guided around the guide rollers (12) on the casing wall and around the guide rollers (13) on the film rocker (11).

8. The banderoling machine according to claim 1, further comprising a compressed-air-actuated roller brake for braking the working film web (9), and a switch provided on a film rocker (11) for releasing the roller brake when the film rocker reaches a predetermined angle.

9. The banderoling machine according to claim 1, characterised in that a device for continuously determining the roll thickness is provided; to output a signal to trigger the film clamping process and/or the heating process for heating the appropriate heating element.

10. The banderoling machine according to claim 1, characterised in that a temperature sensor to output a signal to trigger the separating heat-sealing process on reaching a desired temperature, is provided on the heating elements (43,44).

11. The banderoling machine according to claim 10, wherein the temperature is 180° C.

12. The banderoling machine according to claim 1, characterised in that the supply film roll (8) and the working film roll (9) do not have a drive.

13. A method for executing a waste-free film change in a banderoling machine according to claim 1, characterised in that the supply film roll (8) of a supply film web is placed on a suitable holder and the supply film web (22) is guided through a first film slot (18,19) allocated thereto between one separating heat-sealing device and the central component (16) of the film sealing unit (10), said supply film web is guided around the central component (16) and through a second film slot (19,18) allocated thereto between the other separating heat-sealing device and the central component through which runs the working film web (3), wherein the excess portion of the supply film web (34) is then clamped by a clamping mechanism (31), whereupon at a later point in time the supply film web (22) and the working film web (3) located next to one another are separated by means of the separating heat-sealing device, wherein in the same working step, the working film web is heat-sealed with the supply film web and the excess portion of the supply film web (34) is heat-sealed with the remainder portion of the working film web by means of the separating heat-sealing device, whereupon the working film web is exchanged for the supply film web.

14. The method according to claim 13, characterised in that a separating heat-sealing process comprises the following steps:

moving a countertool (39,40) towards a spring-loaded plate (47,48), the spring-loaded plate having an opening (49,50);

clamping the supply film web and the working film web between the clamping strips (51,52) on the heat-sealing devices (36,37) and the spring-loaded plate (47,48);

heating a heating element (43,44);

pressing the spring-loaded plate (47,48) with the film webs clamped thereon against the spring force towards the heating element (43,44);

separating the film webs with a separating edge (45,46);

forming a new working film web by heat-sealing the working film web with the supply film web;

simultaneously with the forming step, heat-sealing the excess portion of the supply film web (34) with the remainder portion of the working film web;

maintaining the countertool against the spring-loaded plate or further clamping the film webs, if necessary, to strengthen each seam; and releasing each seam simultaneously.

15. The method according to claim 13 characterised in that the film clamping process and the heating of the corresponding heating element is triggered by the output of a control signal from a device for determining the film thickness if the working film roll (9) goes below a minimum thickness.

16. The method according to claim 13 characterised in that a film rocker (11) of the machine triggers a switch on reaching a predetermined angle, whereupon compressed-air-actuated film roll brakes are released.

17. A banderoling machine for banderoling a material with film rolls arranged on both sides of a feed table, whose film webs are joined together by a seal seam to form a film curtain which passes through a slot in the feed table, wherein the material to be banderoled is pushed towards the film curtain, the film curtain is placed around the material to form a loop and the loop is tightened by means of a tensioning device, which temporarily clamps at least one of the film webs, and the loop is heat-sealed by means of a heat-sealing device and separated from the remainder of the film curtain, wherein at least on one side of the feed table, there is provided a film changing unit (7) comprising at least one supply film roll (8) of a supply film web and at least one working film roll (9) of a working film web, wherein the working film web (3) and the supply film web (22) are guided through a film sealing unit (10), wherein the film sealing unit (10) comprises two separating heat-sealing devices (36,37), each adapted to produce a pinch-separating seam, and a central component provided between the two separating heat-sealing devices, wherein each of the two separating heat-sealing devices (36,37) comprises assemblies separated from one another by a film slot (18,19), the assemblies comprise a heating element (43,44) and a countertool (39,40), wherein two appropriately spaced clamping strips (51,52) are provided on the heating element (43,44) or on the countertool (39,40), wherein a separating edge (45, 46) is provided between the spaced clamping strips (51, 52) either on the heating element (43,44) or on the countertool (39,40), wherein at least one of the two assemblies is movable onto the other, to produce the pinch-separating seam between the supply film web and the working film web and between an excess portion of the supply film web (34) and a remainder portion of the working film web, in one working process, wherein the central component comprises a clamping mechanism (31) having a strip (32) and a magnet (35) for holding the strip (32) when in an open position, and wherein the strip is pressed by means of spring force (33) against the central component.

18. A banderoling machine for banderoling a material with film rolls arranged on both sides of a feed table, whose film webs are joined together by a seal seam to form a film curtain which passes through a slot in the feed table, wherein the material to be banderoled is pushed towards the film curtain, the film curtain is placed around the material to form a loop and the loop is tightened by means of a tensioning device, which temporarily clamps at least one of the film webs, and the loop is heat-sealed by means of a heat-sealing device and separated from the remainder of the film curtain, wherein at least on one side of the feed table, there is provided a film changing unit (7) comprising at least one supply film roll (8) of a supply film web and at least one working film roll (9) of a working film web, wherein the working film web (3) and the supply film web (22) are guided through a film sealing unit (10), wherein the film sealing unit (10) comprise two separating heat-sealing devices (36,37), each adapted to produce a pinch-separating seam, wherein each of the two separating heat-sealing devices (36,37) comprises assemblies separated from one another by a film slot (18,19), the assemblies comprises a heating element (43,44) and a countertool (39,40), wherein two appropriately spaced clamping strips (51,52) are provided on the heating element (43,44) or on the countertool (39,40), wherein a separating edge (45,46) is provided between the spaced clamping strips (51,52) either on the heating element (43,44) or on the countertool (39,40), wherein at least one of the two assemblies is movable onto the other, to produce the pinch-separating seam between the supply film web and the working film web and between an excess portion of the supply film web (34) and a remainder portion of the working film web, in one working process, wherein a working film web guide roller (24) is provided at a distance from the film sealing unit, wherein the working film web guide roller (24) is tiltable between two predetermined positions (28,29) so that the working film web always runs along an outer film slot edge (23,38), depending on the film slot (18,19) said film web is guided through.

19. A method for executing a waste-free film change in a banderoling machine, characterised in that a supply film roll (8) of a supply film web is placed on a suitable holder and the supply film web (22) is guided through a first film slot (18,19) allocated thereto between a first separating heat-sealing device and a central component (16) of a film sealing unit (10), said supply film web is guided around the central component (16) and through a second film slot (19,18) allocated thereto between a second separating heat-sealing device and the central component through which runs a working film web (3), wherein an excess portion of the supply film web (34) is then clamped by a clamping mechanism (31), whereupon at a later point in time the supply film web (22) and the working film web (3) located next to one another are separated by means of the separating heat-sealing device, wherein in the same working step, the working film web is heat-sealed with the supply film web and the excess portion of the supply film web (34) is heat-sealed with a remainder portion of the working film web by means of the separating heat-sealing device, whereupon the working film web is exchanged for the supply film web, wherein a working film web guide roll (24), provided at a distance from the separating heat-sealing device of the machines, is tiltable between a first position (28,29) and a second position (29,28), so that the working film web or supply film web being drawn by the machine runs along the outside (23,38) of the film slot (18,19).

20. A banderoling machine with film rolls arranged on both sides of a feed table, whose film webs are joined together by a seal seam to form a film curtain which passes through a slot in the feed table, wherein the machine includes a tensioning device and a heat-sealing device, and material to be banderoled is pushed towards the film curtain, the film is placed around the material to form a loop and the loop is tightened by means of the tensioning device, which temporarily clamps at least one of the film webs, and is heat-sealed by means of the heat-sealing device and separated from the remainder of the film, wherein at least on one side of the feed table, especially on both sides of the feed table, there is provided a film changing unit (7) comprising at least one supply film roll (8) and one working film roll (9), wherein both the working film web (3) and also the supply film web (22) is guided through a film sealing unit (10), wherein the film sealing unit (10) comprises at least one separating heat-sealing device (36,37) to produce a pinch-separating seam between the old working film web and the supply film webs, characterized in that between the excess supply film web (34) and the remainder of the old working film web an additional pinch-separating seam is produced in one working process, a tiltable working film web guide roller (24) being provided at a distance from the film sealing unit, which can be tilted into two positions (28,29) by which the working film always runs along the outer film slot edge (23,38) depending on which film slot (18,19) said film is guided through.

* * * * *